US006926212B1

(12) United States Patent
Glass

(10) Patent No.: US 6,926,212 B1
(45) Date of Patent: Aug. 9, 2005

(54) DEVICE FOR ADDING SOAP TO A WATER INLET

(76) Inventor: George Glass, 4700 St. Catherine West #311, Westmount, Quebec (CA) H3Z 1S6

( * ) Notice: Subject to any disclaimer, the term of this patent is extended or adjusted under 35 U.S.C. 154(b) by 149 days.

(21) Appl. No.: 10/407,521

(22) Filed: Apr. 7, 2003

(51) Int. Cl.[7] ..... B05B 7/30

(52) U.S. Cl. ..... 239/318; 239/310; 239/313; 239/320; 239/333; 239/354; 239/578; 239/581.1; 222/145.1; 222/372

(58) Field of Search ..... 239/310, 313, 239/318, 320, 329, 331, 333, 334, 354, 577, 239/578, 581.1, 570, 571; 222/372, 380, 222/382, 145.1, 145.5; 4/903

(56) References Cited

U.S. PATENT DOCUMENTS

| | | | | | |
|---|---|---|---|---|---|
| 1,066,660 | A | * | 7/1913 | Ross | 222/380 |
| 3,486,695 | A | * | 12/1969 | Novak | 239/318 |
| 3,713,585 | A | * | 1/1973 | Conklin | 239/310 |
| 3,764,074 | A | | 10/1973 | James | |
| 4,121,773 | A | | 10/1978 | Headen et al. | |
| 4,193,520 | A | | 3/1980 | Duffield | |
| 4,281,796 | A | * | 8/1981 | Fugent et al. | 239/310 |
| 4,360,130 | A | * | 11/1982 | Nishimura et al. | 222/380 |
| 4,651,930 | A | | 3/1987 | Magaha, Jr. | |
| 5,004,158 | A | * | 4/1991 | Halem et al. | 239/313 |
| 5,046,648 | A | * | 9/1991 | Herbstzuber | 222/372 |
| D326,896 | S | | 6/1992 | McNeely | |
| 5,135,173 | A | * | 8/1992 | Cho | 239/310 |
| 5,356,076 | A | | 10/1994 | Bishop | |
| 5,716,005 | A | * | 2/1998 | McMahan | 239/318 |
| 6,543,651 | B2 | * | 4/2003 | Lewis et al. | 222/380 |

* cited by examiner

*Primary Examiner*—Steven J. Ganey

(57) ABSTRACT

A device for adding soap to a water inlet includes a pump that is positioned in a housing. An actuator for actuating the pump is pivotally mounted on the housing. The pump is fluidly coupled to a reservoir positioned in the housing. A soap inlet is fluidly coupled to the reservoir. A container, having liquid soap therein, is fluidly coupled to the soap inlet by a soap conduit such that the liquid soap is drawn into the reservoir when the pump is actuated. A soap outlet is fluidly coupled to the reservoir. A delivery conduit is fluidly coupled to and extends between the soap outlet and the water inlet conduit such that liquid soap positioned in the reservoir is delivered to a water inlet conduit for a shower when the pump is actuated.

3 Claims, 3 Drawing Sheets

DEVICE FOR ADDING SOAP TO A WATER INLET

BACKGROUND OF THE INVENTION

1. Field of the Invention

The present invention relates to soap dispensing devices and more particularly pertains to a new soap dispensing device for adding liquid soap to water as it travels to a showerhead.

2. Description of the Prior Art

The use of soap dispensing devices is known in the prior art. While these devices fulfill their respective, particular objectives and requirements, the need remains for a device that includes a pre-measured amount of influx of liquid soap into a water inlet and one-way valves that ensure no back-flow of water into the liquid soap dispenser.

SUMMARY OF THE INVENTION

The present invention meets the needs presented above by utilizing a pump fluidly coupling a container having liquid soap therein and a water inlet for a shower. By use of a plurality of one-way valves, the user is ensured that a measured quantity of soap will be delivered to the water inlet.

Another object of the present invention is to provide a new soap dispensing device that includes a drainage outlet for draining a reservoir of the pump so that the pump may be more easily cleaned.

To this end, the present invention generally comprises a pump that is positioned in a housing. An actuator for actuating the pump is pivotally mounted on the housing. The pump is fluidly coupled to a reservoir positioned in the housing. A soap inlet is fluidly coupled to the reservoir. A container, having liquid soap therein, is fluidly coupled to the soap inlet by a soap conduit such that the liquid soap is drawn into the reservoir when the pump is actuated. A soap outlet is fluidly coupled to the reservoir. A delivery conduit is fluidly coupled to and extends between the soap outlet and the water inlet conduit such that liquid soap positioned in the reservoir is delivered to a water inlet conduit for a shower when the pump is actuated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
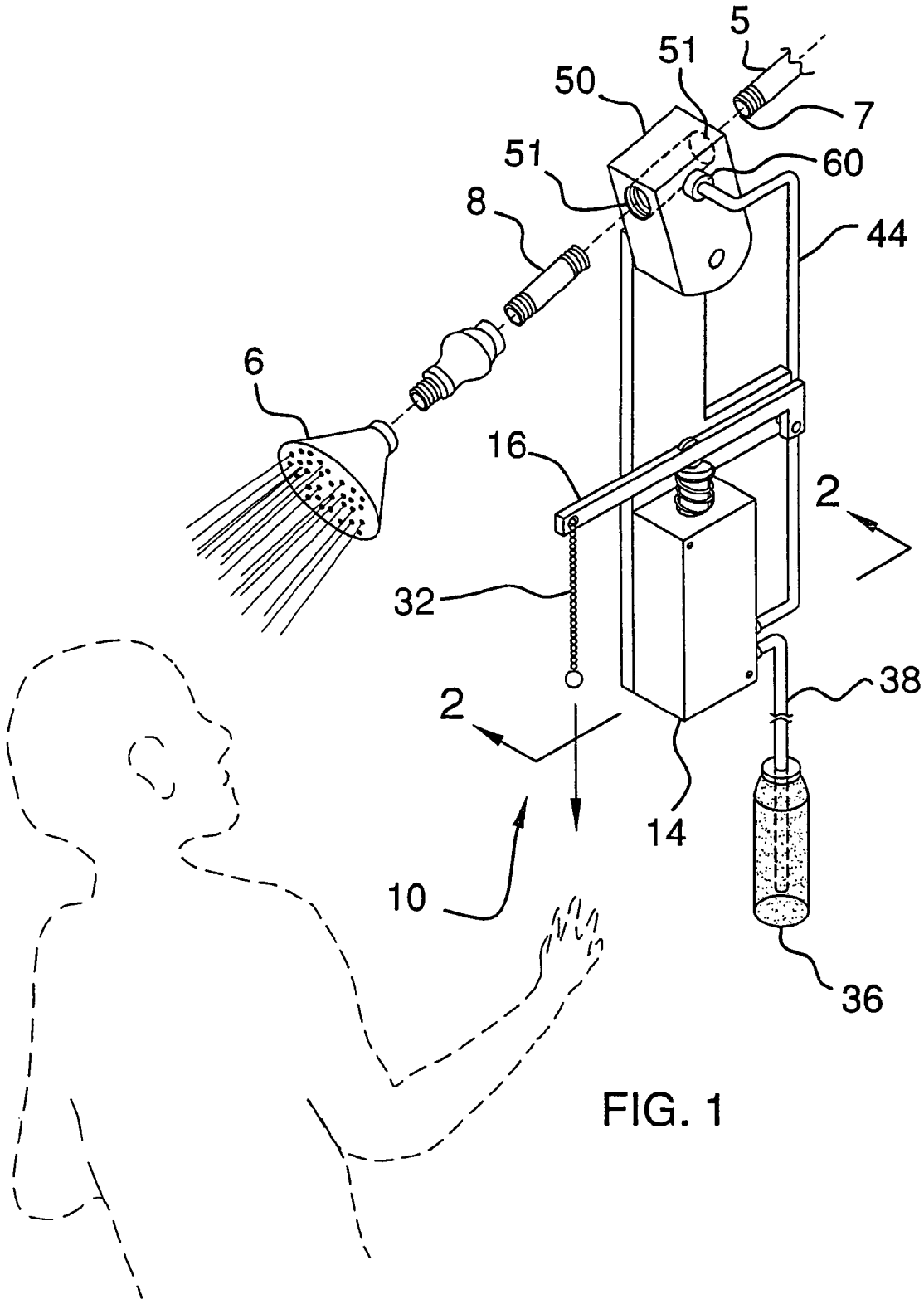
FIG. 1 is a schematic perspective in-use view of a device for adding soap to a water inlet according to the present invention.
Figure 2:
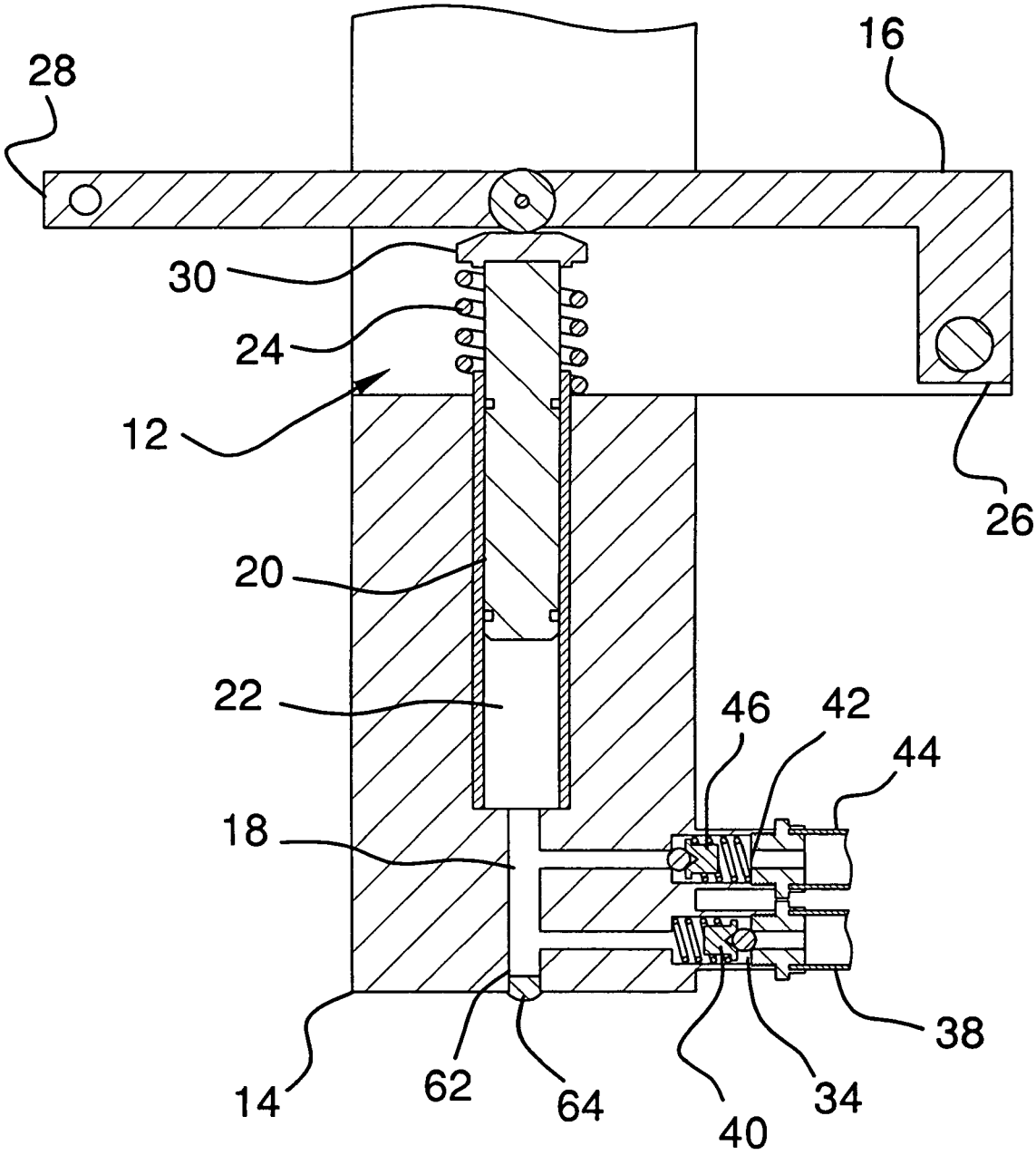
FIG. 2 is a schematic cross-sectional view taken along line 2—2 of FIG. 1 of the present invention.
Figure 3:
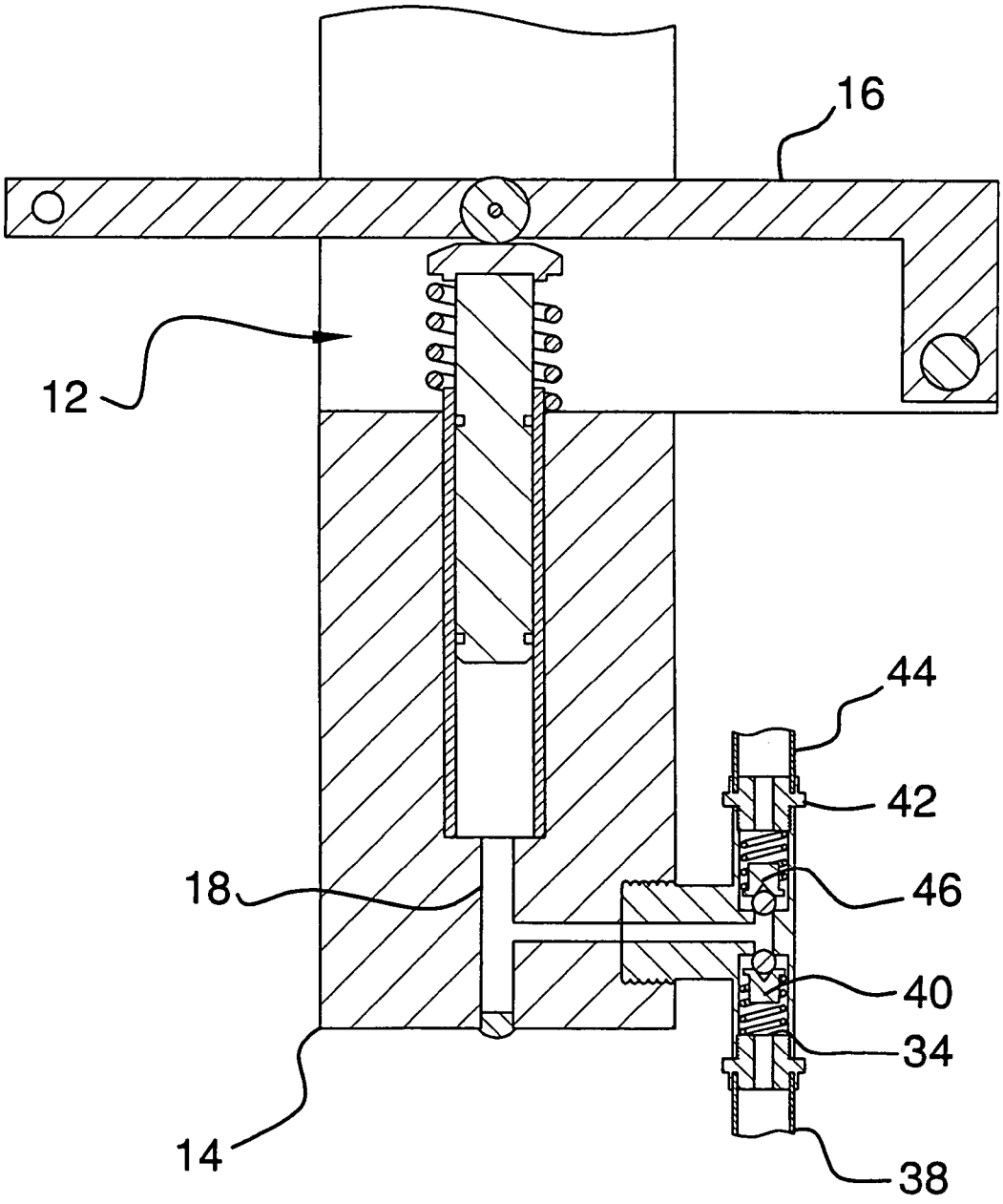
FIG. 3 is a schematic cross-sectional view of a second embodiment of the present invention.

With reference now to the drawings, and in particular to FIGS. 1 through 3 thereof, a new soap dispensing device embodying the principles and concepts of the present invention and generally designated by the reference numeral 10 will be described.

As best illustrated in FIGS. 1 through 3, the device for adding soap to a water inlet 10 generally comprises a pump 12 positioned in a housing 14. An actuator 16 for actuating the pump 12 is pivotally mounted on the housing 14. The pump 12 is fluidly coupled to a reservoir 18 positioned in the housing 14. Preferably, the pump 12 includes a piston 20 and cylinder 22 which are in fluid communication with the reservoir 18. A biasing member 24 biases the piston 20 upwardly. The biasing member 24 is preferably a spring. The actuator 16 ideally comprises an elongated member having a first end 26 pivotally coupled to the housing 14 and a second end 28 extending freely away therefrom. An upper end 30 of the piston 20 is pivotally attached to the elongated member, or actuator 16, at a point generally between the first 26 and second ends 28. The user actuates the pump 12 by pulling downward on the second end 28 of the elongated member 16. A chain 32 or other type of tether may be attached to the second end 28 to facilitate the actuating of the pump 12.

A soap inlet 34 is fluidly coupled to the reservoir 18. A container 36, in which liquid soap may be positioned, is fluidly coupled to the soap inlet 34 by a soap conduit 38. By this manner, liquid soap positioned in the container 36 is drawn into the reservoir 18 when the pump 12 is actuated. Preferably, a first one-way valve 40 is positioned in the soap inlet 34 such that fluid may only flow inward of the reservoir 18 through the soap inlet 34.

A soap outlet 42 is fluidly coupled to the reservoir 18. A delivery conduit 44 is fluidly coupled to and extends between the soap outlet 42 and a water inlet conduit 5 for a showerhead 6 such that liquid soap positioned in the reservoir 18 is delivered to the water inlet conduit 5 when the pump 12 is actuated. Preferably, a second one-way valve 46 is positioned in the soap outlet 42 such that fluid may only flow outward of the reservoir 18 through the soap outlet. FIG. 2 shows the first embodiment of this construction of soap inlets and outlets as well as the first and second one-way valves, while FIG. 3 depicts a second embodiment which would function in the same manner as the first embodiment.

The delivery conduit 44 ideally terminates in a connector housing 50 having a pair of oppositely positioned threaded apertures 51 extending therein. This will facilitate retrofitting the device 10 to a current shower fixture by simply removing the showerhead 6, threadably coupling the connector housing 50 to the terminal end 7 of the water inlet 5, threadably coupling a small connector pipe 8 to the connector housing 50, and coupling the showerhead 6 to the connector pipe 8.

Ideally, a third, or a primary 60, one-way valve is fluidly coupled to the delivery conduit 44 such that fluid may only flow outwardly from the delivery conduit 44 and into the water inlet conduit 5. The primary valve 60 ensures that water will not enter the reservoir 18 through the delivery conduit 44 while the first 40 and second 46 one-way valves ensure that the delivery amounts of liquid soap remain substantially constant.

A drainage outlet 62 extends into the housing 14 and into the reservoir 18, and preferably extends downward from the reservoir 18. A plug 64 is removably positioned in the drainage outlet 62 for selectively opening or closing the drainage outlet 62. The drainage outlet 62 allows for removal of the contents of the reservoir 18 for cleaning purposes and for changing soaps.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for adding soap to a water inlet conduit of a shower, said device comprising:

a pump being positioned in a housing, an actuator for actuating said pump being pivotally mounted on said housing, said pump being fluidly coupled to a reservoir positioned in said housing;

a soap inlet being fluidly coupled to said reservoir;

a container, wherein liquid soap may be positioned within said container;

a soap conduit fluidly coupling said container to said soap inlet such that liquid soap positioned in said container is drawn into said reservoir when said pump is actuated;

a first one-way valve being positioned in said soap inlet such that fluid may only flow inward of said reservoir through said soap inlet;

a soap outlet being fluidly coupled to said reservoir;

a delivery conduit being fluidly coupled to and extending between said soap outlet and the water inlet conduit such that liquid soap positioned in said reservoir is delivered to said water inlet conduit when said pump is actuated;

a primary one-way valve being fluidly coupled to said delivery conduit such that fluid may only flow outwardly from said delivery conduit and into said water inlet conduit; and a second one-way valve being positioned in said soap outlet such that fluid may only flow outward of said reservoir through said soap outlet.

2. A device for adding soap to a water inlet conduit of a shower, said device comprising:

a pump being positioned in a housing, an actuator for actuating said pump being pivotally mounted on said housing, said pump being fluidly coupled to a reservoir positioned in said housing;

a soap inlet being fluidly coupled to said reservoir;

a container, wherein liquid soap may be positioned within said container;

a soap conduit fluidly coupling said container to said soap inlet such that liquid soap positioned in said container is drawn into said reservoir when said pump is actuated;

a first one-way valve being positioned in said soap inlet such that fluid may only flow inward of said reservoir through said soap inlet;

a soap outlet being fluidly coupled to said reservoir;

a delivery conduit being fluidly coupled to and extending between said soap outlet and the water inlet conduit such that liquid soap positioned in said reservoir is delivered to said water inlet conduit when said pump is actuated;

a primary one-way valve being fluidly coupled to said delivery conduit such that fluid may only flow outwardly from said delivery conduit and into said water inlet conduit;

a second one-way valve being positioned in said soap outlet such that fluid may only flow outward of said reservoir through said soap outlet; and a drainage outlet extending into said housing and into said reservoir, said drainage outlet extending downward from said reservoir, a plug being removably positioned in said drainage outlet for selectively opening or closing said drainage outlet.

3. A device for adding soap to a water inlet conduit of a shower, said device comprising:

a pump being positioned in a housing, an actuator for actuating said pump being pivotally mounted on said housing, said pump being fluidly coupled to a reservoir positioned in said housing;

a soap inlet being fluidly coupled to said reservoir;

a container, wherein liquid soap may be positioned within said container;

a soap conduit fluidly coupling said container to said soap inlet such that liquid soap positioned in said container is drawn into said reservoir when said pump is actuated;

a soap outlet being fluidly coupled to said reservoir;

a delivery conduit being fluidly coupled to and extending between said soap outlet and the water inlet conduit such that liquid soap positioned in said reservoir is delivered to said water inlet conduit when said pump is actuated;

a primary one-way valve being fluidly coupled to said delivery conduit such that fluid may only flow outwardly from said delivery conduit and into said water inlet conduit; and a drainage outlet extending into said housing and into said reservoir, said drainage outlet extending downward from said reservoir, a plug being removably positioned in said drainage outlet for selectively opening or closing said drainage outlet.

* * * * *